US010017995B2

(12) United States Patent
Dawson

(10) Patent No.: US 10,017,995 B2
(45) Date of Patent: Jul. 10, 2018

(54) PENETRATING A SUBTERRANEAN FORMATION

(71) Applicant: Matthew A. Dawson, Sugar Land, TX (US)

(72) Inventor: Matthew A. Dawson, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 116 days.

(21) Appl. No.: 14/402,068

(22) PCT Filed: Jun. 12, 2013

(86) PCT No.: PCT/US2013/045456
§ 371 (c)(1),
(2) Date: Nov. 18, 2014

(87) PCT Pub. No.: WO2014/028106
PCT Pub. Date: Feb. 20, 2014

(65) Prior Publication Data

US 2015/0285002 A1 Oct. 8, 2015

Related U.S. Application Data

(60) Provisional application No. 61/682,626, filed on Aug. 13, 2012, provisional application No. 61/704,118, filed on Sep. 21, 2012.

(51) Int. Cl.
*E21B 7/06* (2006.01)
*E21B 3/00* (2006.01)
(Continued)

(52) U.S. Cl.
CPC ..... *E21B 7/061* (2013.01); *E21B 3/00* (2013.01); *E21B 4/02* (2013.01); *E21B 7/04* (2013.01);
(Continued)

(58) Field of Classification Search
CPC ... E21B 7/061; E21B 1/00; E21B 3/00; E21B 6/00; E21B 4/02; E21B 7/00; E21B 7/18; E21B 41/0035; E21B 17/20; E21B 7/04
See application file for complete search history.

(56) References Cited

U.S. PATENT DOCUMENTS 2,745,647 A * 5/1956 Gilmore ..... E21B 43/292 175/205
3,402,965 A * 9/1968 Dahms ..... E21B 43/292 137/355.28
(Continued)

OTHER PUBLICATIONS

Freyer, R. et al. (2009), "Multilateral System Allowing 100 Level 5 Laterals Drilled Simultaneously," SPE 121814, 2009 SPE European Formation Damage Conference, Scheveningen, The Netherlands, May 27-29, 2009, 7 pgs.
(Continued)

*Primary Examiner* — Michael R Wills, III
(74) *Attorney, Agent, or Firm* — ExxonMobil Upstream Research Company—Law Department

(57) ABSTRACT

Methods and systems for penetrating a subsurface formation are disclosed. An exemplary apparatus includes a kicker configured to direct a drilling apparatus towards a well casing and a flexible hose configured to convey a fluid from a surface pump to the drilling apparatus. The drilling apparatus includes a drill bit configured to penetrate a well casing and a subsurface formation, and wherein the drilling apparatus is configured to pull the flexible hose into the subsurface formation as the drilling apparatus penetrates the subsurface formation.

27 Claims, 9 Drawing Sheets

(51) Int. Cl.

| | |
|---|---|
| ***E21B 4/02*** | (2006.01) |
| ***E21B 7/18*** | (2006.01) |
| ***E21B 17/20*** | (2006.01) |
| ***E21B 41/00*** | (2006.01) |
| ***E21B 7/04*** | (2006.01) |

(52) U.S. Cl.
CPC ..... *E21B 7/18* (2013.01); *E21B 17/20* (2013.01); *E21B 41/0035* (2013.01)

(56) References Cited

U.S. PATENT DOCUMENTS 3,402,985 A 9/1968 Galvin
4,497,381 A 2/1985 Dickinson, III et al.
4,787,465 A 11/1988 Dickinson, III et al.
5,183,111 A * 2/1993 Schellstede ..... E21B 7/18 166/212
5,462,120 A 10/1995 Gondouin
5,469,925 A 11/1995 Mueller et al.
5,533,573 A 7/1996 Jordan, Jr. et al.
6,076,606 A * 6/2000 Bailey ..... E21B 7/061 166/117.6
6,920,945 B1 7/2005 Belew et al.
7,419,223 B2 9/2008 Seams
7,584,794 B2 9/2009 Butler et al.
7,669,672 B2 3/2010 Brunet et al.
7,699,107 B2 4/2010 Butler et al.
7,726,404 B2 6/2010 Kubala et al.
8,297,364 B2 10/2012 Agrawal et al.
8,322,409 B2 12/2012 Freyer
2003/0192718 A1* 10/2003 Buckman, Sr. ..... E21B 7/18 175/62
2003/0213590 A1* 11/2003 Bakke ..... E21B 7/18 166/55.3
2004/0129330 A1* 7/2004 Seyler ..... F16L 11/045 138/138
2006/0151041 A1* 7/2006 Koizumi ..... B21D 15/06 138/118
2007/0039729 A1 2/2007 Watson et al.
2008/0179061 A1* 7/2008 McAfee ..... E21B 43/112 166/298
2009/0101414 A1 4/2009 Brunet et al.
2009/0255732 A1* 10/2009 Peters ..... E21B 7/061 175/62
2010/0187012 A1 7/2010 Belew et al.
2010/0258316 A1 10/2010 Lockhart et al.
2010/0258317 A1 10/2010 Lockhart et al.
2011/0017445 A1 1/2011 Freyer
2011/0048566 A1* 3/2011 Theis ..... B29C 47/023 138/124
2011/0198083 A1 8/2011 Lockhart et al.
2011/0272153 A1 11/2011 Boone et al.
2012/0067580 A1* 3/2012 Parsche ..... E21B 43/2401 166/302
2012/0160567 A1* 6/2012 Belew ..... E21B 7/061 175/67
2012/0228033 A1* 9/2012 Mazarac ..... E21B 7/18 175/67
2012/0279577 A1* 11/2012 Goering ..... F16L 11/083 137/13
2013/0126174 A1* 5/2013 Henson ..... E21B 43/26 166/308.1
2016/0017693 A1* 1/2016 Winslow ..... E21B 41/0085 175/95

OTHER PUBLICATIONS

Freyer, R. et al. (2011), "Laterals Stimulation Method," SPE 143381, Brazil Offshore Conference and Exhibition, Macae, Brazil, Jun. 14-17, 2011, 7 pgs.
Vestavik, O.M. et al. (1995), "Casing Window Milling with Abrasive Fluid Jet," SPE 30453, SPE Annual Technical Conference & Exhibition, Dallas, Texas, Oct. 22-25, 1995, pp. 45-49.
http://www.radjetcom Radjet Technology, Sep. 7, 2011, 5 pages.

* cited by examiner

116

202

500

600

700

800

900

1000

1100

PENETRATING A SUBTERRANEAN FORMATION

This application is the National Stage of International Application No. PCT/US2013/045456, filed 12 Jun. 2013, which claims the benefit of U.S. Provisional Application No. 61/682,626, filed 13 Aug. 2012 and U.S. Provisional No. 61/704,118, filed 21 Sep. 2012, the entirety of which is incorporated herein by reference for all purposes.

FIELD

The present techniques relate to increasing flow from a subterranean formation. Specifically, techniques are disclosed for drilling small lateral holes out from a central wellbore to enhance the flow to the central wellbore.

BACKGROUND

This section is intended to introduce various aspects of the art that may be topically associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

As conventional hydrocarbon reservoirs (e.g., high-permeability onshore reservoirs, high-permeability reservoirs located in shallow ocean water, etc.), are depleted other hydrocarbon sources must be developed to keep up with energy demands. Such reservoirs may include any number of unconventional hydrocarbon reservoirs, such as heavy oil reservoirs, deep-water oil reservoirs, and natural gas reservoirs.

One such unconventional hydrocarbon resource is natural gas produced from formations that form unconventional gas reservoirs, including, for example, shale reservoirs and coal seams. Because unconventional gas reservoirs may have insufficient permeability to allow significant fluid flow to a wellbore, many of such unconventional gas reservoirs are currently not considered as economically attractive sources of natural gas. However, natural gas has been produced for years from low permeability reservoirs having natural fractures. Furthermore, a significant increase in shale gas production has resulted from hydraulic fracturing, which can be used to create extensive artificial fractures around wellbores. When combined with horizontal drilling, which is becoming more commonly used in industry, the hydraulic fracturing may allow formerly unattractive reservoirs to become commercially viable.

Currently, many shale gas, tight gas, and tight oil formations are hydraulically fractured using a combination of water, proppant, and chemicals to create higher connectivity in the formation and enhance both recovery rates and cumulative volumes produced from a single horizontal wellbore. This method has proven to be economically viable, but has encountered some opposition. Some of the concerns involve the release of chemicals into the subsurface, the large quantities of water utilized in the process, and the noise and truck traffic associated with the process.

The industry is also concerned with several aspects of hydraulic fracturing, including the volumes of water, and the costs. The volumes of water used in hydraulic fracturing are often very large, and may exceed several million barrels of water per fracture job. In many locations in the United States, water is quite scarce, so water sourcing can be an issue. In addition, a substantial fraction of the injected water, for example, between 10-50%, can be produced back and may require treatment. Transport, treatment, and disposal of this water can be quite costly, for example, in excess of $10/bbl in parts of the northeastern United States. Moreover, a typical hydraulic fracturing process can require 10 or more stages with each stage costing $100,000-$300,000.

As a result of some of these issues, some governmental entities are proposing bans on hydraulic fracturing, jeopardizing the access to the resources. Technologies that can provide access to shale gas resources without the use of hydraulic fracturing may become the preferred means of production enhancement in these formations by many government bodies.

Several patents and pieces of literature discuss creating lateral wells to increase production from reservoirs without fracturing. For example, U.S. Pat. No. 5,533,573 to Jordan et al. (the '573 patent) discusses a method for completing multi-lateral wells and maintaining selective re-entry into laterals. A first lateral well is drilled from a primary well bore and a string of external casing packers and a packer bore receptacle are run into the first lateral well. Once the orientation of the packer bore receptacle is determined, an orientation anchor of a retrievable whipstock assembly is mounted thereto. Thereafter, a second lateral well may be drilled. Once the second lateral well is drilled, the whipstock assembly may be retrieved and replaced with a scoophead diverter assembly which also includes an orientation anchor for mating with the packer bore receptacle. At this time, a string of external casing packers may be run into the second lateral well through the scoophead diverter assembly. Finally, a selective reentry tool is run into the scoophead assembly. The selective re-entry tool includes a diversion flapper for selecting either the first or second lateral well bore. Selective re-entry is desirable for the purpose of performing well intervention techniques. The re-entry tool may be actuated by a device located on a coil tubing work string which may be operated from the surface.

U.S. Patent Application Publication No. 2011/0017445, by Freyer, discloses a method and device for making lateral openings out of a wellbore in a well formation. In a disclosed method, fluid is flowed through a motherbore tubular, such as a completion or production pipe, and then through a needle pipe that is aimed at the formation. The needle pipe, which includes at least one pipe section, is positioned inside or outside a motherbore tubular and the pipe sections is positioned to be telescopically displaceable with regard to another pipe.

An important factor in drilling a lateral well off of a main wellbore is the penetration of a casing. For example, wells may have a concrete casing, an iron casing, a steel casing, and the like. A number of developments have focused on drilling lateral wells from a cased well, including, for example, the '573 patent, which details a more traditional lateral drilling procedure.

U.S. Pat. No. 6,920,945 to Belew et al. (the '945 patent) describes a method and system for facilitating horizontal drilling in a well. A shoe that has a passageway extending from an upper opening to a side opening is positioned in the well. A rod connected to a casing mill end through a universal joint is inserted into the well casing and through the passageway in the shoe until the casing mill end abuts the well casing. The rod and casing mill end are then rotated until the casing mill end forms a perforation in the well casing. The rod and casing mill end are then withdrawn from the well casing, and a nozzle attached to the end of a flexible hose is extended through the passageway to the perforation.

Fluid is then ejected from the nozzle and impinges and erodes subterranean formation material.

U.S. Patent Application Publication No. 2010/0187012, by Belew et al., (the '012 application) describes a method and apparatus for laterally drilling through a subterranean formation. An exemplary apparatus includes an internally rotating nozzle for facilitating drilling through a subterranean formation. The internally rotating nozzle is mounted internally within a housing connected to a hose for receiving high pressure fluid. The rotor includes at least two tangential jets oriented off of center for ejecting fluid to generate torque and rotate the rotor and cut a substantially cylindrical tunnel in the subterranean formation.

However, neither the '945 patent nor the '012 application indicates that the apparatus at the end of the flexible hose either drills through the casing prior to drilling into the formation or is capable of doing so. Instead, as described in the '945 patent, a separate tool that includes a casing mill is used to cut holes in the casing. This tool is then withdrawn prior to insertion of the apparatus that is used to drill into the formation.

These references disclose the formation of laterals drilled from a central wellbore. However, none of the reference discussed above disclose drilling small lateral wells from a main wellbore in a single operation that penetrates a well casing and a subterranean formation.

SUMMARY

An embodiment described herein provides an apparatus for penetrating a subsurface formation. The apparatus includes a kicker configured to direct a drilling apparatus towards a well casing and a flexible hose configured to convey a fluid from a surface pump to the drilling apparatus. The drilling apparatus includes a drill bit configured to penetrate a well casing and a subsurface formation, and wherein the drilling apparatus is configured to pull the flexible hose into the subsurface formation as the drilling apparatus penetrates the subsurface formation.

Another embodiment provides a method of creating a high flow network in subterranean formation. The method includes positioning a kicker in a wellbore at a target location and locking the kicker in place at the target location. A drilling assembly that includes a flexible hose and a drilling apparatus is threaded from the surface into the kicker, wherein the kicker is configured to direct the drilling assembly at a casing of the wellbore. A fluid is injected into the flexible hose, wherein a fluid flow through the flexible hose drives the drilling apparatus to penetrate through the casing and into the subterranean formation and to pull the associated flexible hose into the formation.

Another embodiment provides a method of producing hydrocarbons from a subterranean formation. The method includes creating a high flow network in the subterranean formation by drilling a small lateral well from a main well by positioning a kicker in a wellbore at a target location and locking the kicker in place at the target location. A drilling assembly that includes a flexible hose and a drilling apparatus is threaded from the surface into the kicker, wherein the kicker is configured to direct the drilling assembly at a casing of the wellbore. A fluid is injected into the flexible hose, wherein a fluid flow through the flexible hose drives the drilling apparatus to penetrate through the casing and into the subterranean formation and to pull the associated flexible hose into the formation. Hydrocarbons are then produced from the subterranean formation.

DESCRIPTION OF THE DRAWINGS

The advantages of the present techniques are better understood by referring to the following detailed description and the attached drawings, in which.

Figure 1:
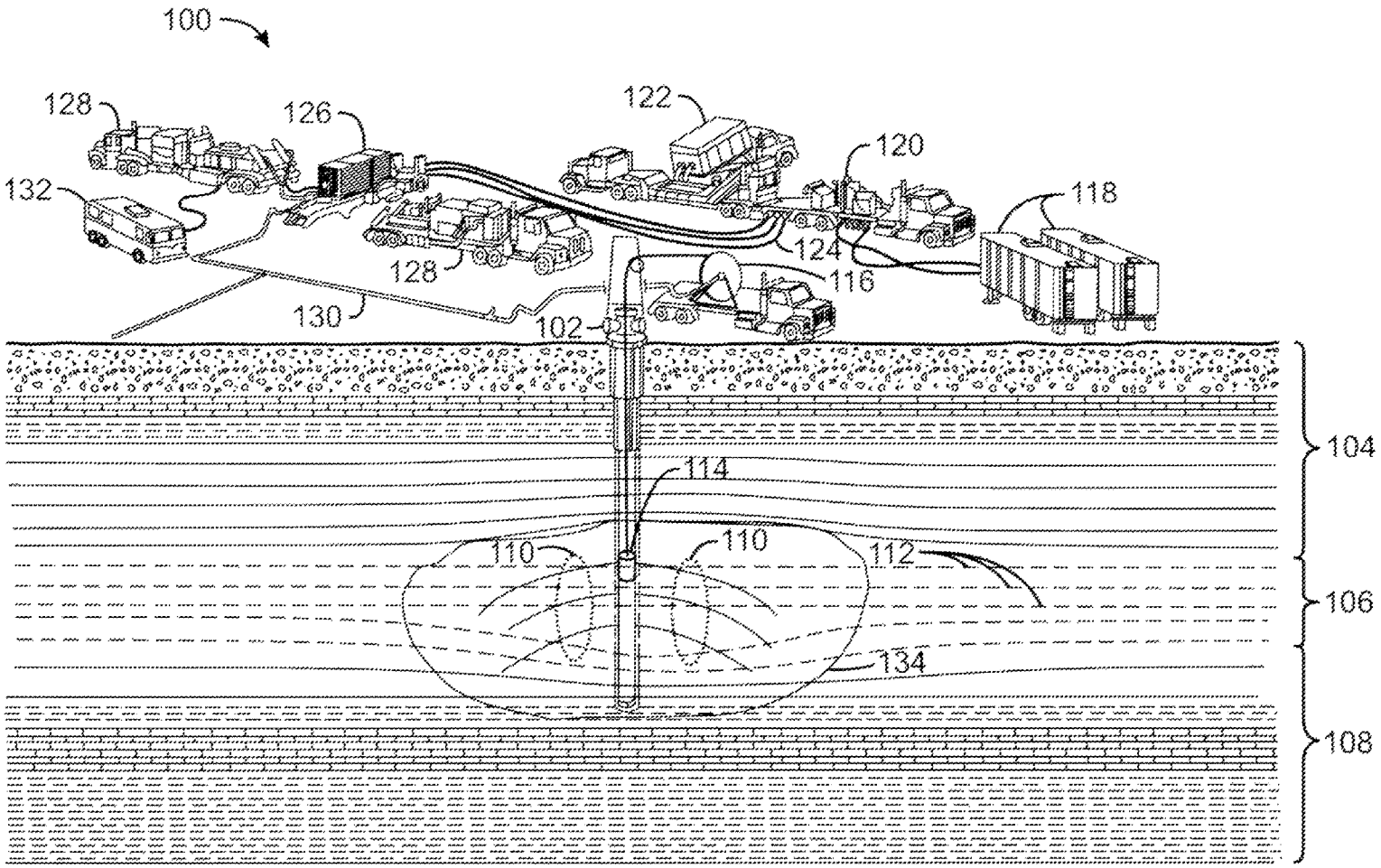
FIG. 1 is a diagram of a drilling process for forming multiple lateral holes into a formation from a central wellbore.

For simplicity and clarity of illustration, elements shown in the drawings have not necessarily been drawn to scale. For example, the dimensions of some of the elements may be exaggerated relative to other elements for clarity. Further, where considered appropriate, reference numerals may be repeated among the drawings to indicate corresponding or analogous elements.

DETAILED DESCRIPTION

In the following detailed description section, the specific embodiments of the present techniques are described in connection with exemplary embodiments. However, to the extent that the following description is specific to a particular embodiment or a particular use of the present techniques, this is intended to be for exemplary purposes only and simply provides a description of the exemplary embodiments. Accordingly, the present techniques are not limited to the specific embodiments described below, but rather, such techniques include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Cleat system" is the system of naturally occurring joints that are created as a coal seam forms over geologic time. A cleat system allows for the production of natural gas if the provided flow to the coal seam is sufficient.

"Coal" is a solid hydrocarbon, including, but not limited to, lignite, sub-bituminous, bituminous, anthracite, peat, and the like. The coal may be of any grade or rank. This can include, but is not limited to, low grade, high sulfur coal that is not suitable for use in coal-fired power generators due to the production of emissions having high sulfur content.

"Coalbed methane" (CBM) is a natural gas that is adsorbed onto the surface of coal. CBM may be substantially comprised of methane, but may also include ethane, propane, and other hydrocarbons. Further, CBM may include some amount of other gases, such as carbon dioxide ($CO_2$) and nitrogen ($N_2$).

"Directional drilling" is the intentional deviation of the wellbore from the path it would naturally take. In other words, directional drilling is the steering of the drill string so that it travels in a desired direction. Directional drilling can be used for increasing the drainage of a particular well, for example, by forming deviated branch bores from a primary borehole. Directional drilling is also useful in the marine environment where a single offshore production platform can reach several hydrocarbon bearing subterranean formations or reservoirs by utilizing a plurality of deviated wells that can extend in any direction from the drilling platform. Directional drilling also enables horizontal drilling through a reservoir to form a horizontal wellbore. As used herein, "horizontal wellbore" represents the portion of a wellbore in a subterranean zone to be completed which is substantially horizontal or at an angle from vertical in the range of from about 45° to about 135°. A horizontal wellbore may have a longer section of the wellbore traversing the payzone of a reservoir, thereby permitting increases in the production rate from the well.

A "facility" is tangible piece of physical equipment, or group of equipment units, through which hydrocarbon fluids are either produced from a reservoir or injected into a reservoir. In its broadest sense, the term facility is applied to any equipment that may be present along the flow path between a reservoir and its delivery outlets, which are the locations at which hydrocarbon fluids either leave the model (produced fluids) or enter the model (injected fluids). Facilities may comprise production wells, injection wells, well tubulars, wellhead equipment, gathering lines, manifolds, pumps, compressors, separators, surface flow lines, and delivery outlets. In some instances, the term "surface facility" is used to distinguish those facilities other than wells.

"Formation" refers to a body or section of geologic strata, structure, formation, or other subsurface solids or collected material that is sufficiently distinctive and continuous with respect to other geologic strata or other characteristics that it can be mapped, for example, by seismic techniques. A formation can be a body of geologic strata of predominantly one type of rock or a combination of types of rock, or a fraction of strata having substantially common set of characteristics. A formation can contain one or more hydrocarbon-bearing subterranean formations. Note that the terms formation, hydrocarbon bearing subterranean formation, reservoir, and interval may be used interchangeably, but may generally be used to denote progressively smaller subsurface regions, zones, or volumes. More specifically, a geologic formation may generally be the largest subsurface region, a hydrocarbon reservoir or subterranean formation may generally be a region within the geologic formation and may generally be a hydrocarbon-bearing zone, a formation, reservoir, or interval having oil, gas, heavy oil, and any combination thereof. An interval or production interval may generally refer to a sub-region or portion of a reservoir. A hydrocarbon-bearing zone, or production formation, may be separated from other hydrocarbon-bearing zones by zones of lower permeability such as mudstones, shales, or shale-like (highly compacted) sands. In one or more embodiments, a hydrocarbon-bearing zone may include heavy oil in addition to sand, clay, or other porous solids.

A "fracture" is a crack, delamination, surface breakage, separation, crushing, rubblization, or other destruction within a geologic formation or fraction of formation that is not related to foliation or cleavage in metamorphic formation, along which there has been displacement or movement relative to an adjacent portion of the formation. A fracture along which there has been lateral displacement may be termed a fault. When walls of a fracture have moved only normal to each other, the fracture may be termed a joint. Fractures may enhance permeability of rocks greatly by connecting pores together, and for that reason, joints and faults may be induced mechanically in some reservoirs in order to increase fluid flow.

"Fracturing" refers to the structural degradation of a treatment interval, such as a subsurface shale formation, from applied thermal or mechanical stress. Such structural degradation generally enhances the permeability of the treatment interval to fluids and increases the accessibility of the hydrocarbon component to such fluids. Fracturing may also be performed by degrading rocks in treatment intervals by chemical means. "Fracture network" refers to a field or network of interconnecting fractures, usually formed during hydraulic fracturing. A "fracture field" is a group of fractures, which may or may not be interconnected, and are created by a single fracturing event, such as by a volumetric change in a zone proximate to a target formation, which fractures the target formation.

"Hydraulic fracturing" is used to create single or branching fractures that extend from the wellbore into reservoir formations so as to stimulate the potential for production. A fracturing fluid, typically a viscous fluid, is injected into the formation with sufficient pressure to create and extend a fracture, and a proppant is used to "prop" or hold open the created fracture after the hydraulic pressure used to generate the fracture has been released. When pumping of the treatment fluid is finished, the fracture may close. The fracture may be artificially held open by injection of a proppant material.

"Hydrocarbon production" refers to any activity associated with extracting hydrocarbons from a well or other opening. Hydrocarbon production normally refers to any activity conducted in or on the well after the well is completed. Accordingly, hydrocarbon production or extraction includes not only primary hydrocarbon extraction but also secondary and tertiary production techniques, such as injection of gas or liquid for increasing drive pressure, mobilizing the hydrocarbon or treating by, for example chemicals or hydraulic fracturing the wellbore to promote increased flow, well servicing, well logging, and other well and wellbore treatments.

"Hydrocarbons" are generally defined as molecules formed primarily of carbon and hydrogen atoms such as oil and natural gas. Hydrocarbons may also include other elements, such as, but not limited to, halogens, metallic elements, nitrogen, oxygen, and/or sulfur. Hydrocarbons may be produced from hydrocarbon bearing subterranean formations through wells penetrating a hydrocarbon containing formation. Hydrocarbons derived from a hydrocarbon bearing subterranean formation may include, but are not limited to, kerogen, bitumen, pyrobitumen, asphaltenes, oils, natural gas, or combinations thereof. Hydrocarbons may be located within or adjacent to mineral matrices within the earth. Matrices may include, but are not limited to, sedimentary rock, sands, silicilytes, carbonates, diatomites, and other porous media.

As used herein, "material properties" represents any number of physical constants that reflect the behavior of a rock. Such material properties may include, for example, Young's modulus (E), Poisson's Ratio (v), tensile strength, compressive strength, shear strength, creep behavior, and other properties. The material properties may be measured by any combinations of tests, including, among others, a "Standard Test Method for Unconfined Compressive Strength of Intact Rock Core Specimens," ASTM D 2938-95; a "Standard Test Method for Splitting Tensile Strength of Intact Rock Core Specimens [Brazilian Method]," ASTM D 3967-95a Reapproved 1992; a "Standard Test Method for Determination of the Point Load Strength Index of Rock," ASTM D 5731-95; "Standard Practices for Preparing Rock Core Specimens and Determining Dimensional and Shape Tolerances," ASTM D 4435-01; "Standard Test Method for Elastic Moduli of Intact Rock Core Specimens in Uniaxial Compression," ASTM D 3148-02; "Standard Test Method for Triaxial Compressive Strength of Undrained Rock Core Specimens Without Pore Pressure Measurements," ASTM D 2664-04; "Standard Test Method for Creep of Cylindrical Soft Rock Specimens in Uniaxial Compressions," ASTM D 4405-84, Reapproved 1989; "Standard Test Method for Performing Laboratory Direct Shear Strength Tests of Rock Specimens Under Constant Normal Stress," ASTM D 5607-95; "Method of Test for Direct Shear Strength of Rock Core Specimen," U.S. Military Rock Testing Handbook, RTH-203-80, available at "http://www.wes.army.mil/SUMTC/handbook/RT/RTH/203-80.pdf" (last accessed on Oct. 1, 2010); and "Standard Method of Test for Multistage Triaxial Strength of Undrained Rock Core Specimens Without Pore Pressure Measurements," U.S. Military Rock Testing Handbook, available at "http://www.wes.army.mil/SUMTC/handbook/RT/RTH/204-80.pdf" (last accessed on Jun. 25, 2010). One of ordinary skill will recognize that other methods of testing rock specimens from formations may be used to determine the physical constants used herein.

"Natural gas" refers to various compositions of raw or treated hydrocarbon gases. Raw natural gas is primarily comprised of light hydrocarbons such as methane, ethane, propane, butanes, pentanes, hexanes and impurities like benzene, but may also contain small amounts of non-hydrocarbon impurities, such as nitrogen, hydrogen sulfide, carbon dioxide, and traces of helium, carbonyl sulfide, various mercaptans, or water. Treated natural gas is primarily comprised of methane and ethane, but may also contain small percentages of heavier hydrocarbons, such as propane, butanes, and pentanes, as well as small percentages of nitrogen and carbon dioxide.

"Overburden" refers to the subsurface formation overlying the formation containing one or more hydrocarbon-bearing zones (the reservoirs). For example, overburden may include rock, shale, mudstone, or wet/tight carbonate (such as an impermeable carbonate without hydrocarbons). An overburden may include a hydrocarbon-containing layer that is relatively impermeable. In some cases, the overburden may be permeable.

"Permeability" is the capacity of a formation to transmit fluids through the interconnected pore spaces of the rock. Permeability may be measured using Darcy's Law: $Q=(k\,\Delta P\,A)/(\mu\,L)$, where Q=flow rate ($cm^3/s$), ΔP=pressure drop (atm) across a cylinder having a length L (cm) and a cross-sectional area A ($cm^2$), p=fluid viscosity (cp), and k=permeability (Darcy). The customary unit of measurement for permeability is the millidarcy. The term "relatively permeable" is defined, with respect to formations or portions thereof, as an average permeability of 10 millidarcy or more (for example, 10 or 100 millidarcy). The term "relatively low permeability" is defined, with respect to formations or portions thereof, as an average permeability of less than about 10 millidarcy. An impermeable layer generally has a permeability of less than about 0.1 millidarcy. By these definitions, shale may be considered impermeable, for example, ranging from about 0.1 millidarcy (100 microdarcy) to as low as 0.00001 millidarcy (10 nanodarcy).

"Porosity" is defined as the ratio of the volume of pore space to the total bulk volume of the material expressed in percent. Although there often is an apparent close relationship between porosity and permeability, because a highly porous formation may be highly permeable, there is no real relationship between the two; a formation with a high percentage of porosity may be very impermeable because of a lack of communication between the individual pores, capillary size of the pore space or the morphology of structures constituting the pore space. For example, the diatomite in one exemplary rock type found in formations, Belridge, has very high porosity, at about 60%, but the permeability is very low, for example, less than about 0.1 millidarcy.

"Pressure" refers to a force acting on a unit area. Pressure is usually shown as pounds per square inch (psi). "Atmospheric pressure" refers to the local pressure of the air. Local atmospheric pressure is assumed to be 14.7 psia, the standard atmospheric pressure at sea level. "Absolute pressure" (psia) refers to the sum of the atmospheric pressure plus the gauge pressure (psig). "Gauge pressure" (psig) refers to the pressure measured by a gauge, which indicates only the pressure exceeding the local atmospheric pressure (a gauge pressure of 0 psig corresponds to an absolute pressure of 14.7 psia).

As previously mentioned, a "reservoir" or "hydrocarbon reservoir" is defined as a pay zone or production interval (for example, a hydrocarbon bearing subterranean formation) that includes sandstone, limestone, chalk, coal, and some types of shale. Pay zones can vary in thickness from less than one foot (0.3048 m) to hundreds of feet (hundreds of m). The permeability of the reservoir formation provides the potential for production.

"Shale" is a fine-grained clastic sedimentary rock that may be found in formations, and may often have a mean grain size of less than 0.0625 mm. Shale typically includes laminated and fissile siltstones and claystones. These materials may be formed from clays, quartz, and other minerals that are found in fine-grained rocks. Non-limiting examples of shales include Barnett, Fayetteville, and Woodford in North America. Shale has low matrix permeability, so gas production in commercial quantities requires fractures to provide flow. Shale gas reservoirs may be hydraulically fractured to create extensive artificial fracture networks around wellbores. Horizontal drilling is often used with shale gas wells.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

"Thermal fractures" are fractures created in a formation caused by expansion or contraction of a portion of the formation or fluids within the formation. The expansion or contraction may be caused by changing the temperature of the formation or fluids within the formation. The change in temperature may change the pressure of fluids within the formation, resulting in the fracturing. Thermal fractures may propagate into or form in neighboring regions significantly cooler than the heated zone.

"Tight oil" is used to reference formations with relatively low matrix permeability, porosity, or both, where liquid hydrocarbon production potential exists. In these formations, liquid hydrocarbon production may also include natural gas condensate.

"Underburden" refers to the subsurface formation below or farther downhole than a formation containing one or more hydrocarbon-bearing zones, e.g., a hydrocarbon reservoir. For example, underburden may include rock, shale, mudstone, or a wet/tight carbonate, such as an impermeable carbonate without hydrocarbons. An underburden may include a hydrocarbon-containing layer that is relatively impermeable. In some cases, the underburden may be permeable. The underburden may be a formation that is distinct from the hydrocarbon bearing formation or may be a selected fraction within a common formation shared between the underburden portion and the hydrocarbon bearing portion. Intermediate layers may also reside between the underburden layer and the hydrocarbon bearing zone.

Overview

The techniques described herein provide methods and systems for penetrating a subsurface formation with a number of lateral wells to create a highly connected network. This network can be used within low permeability formations to enhance hydrocarbon production without the use of fracturing. An exemplary method involves drilling a number of small lateral holes into a formation from a primary wellbore. The number of small lateral holes drilled can be in excess of 2, 10, 50, or 100. The average spacing can be determined by the desired increase in productivity, and may include, for example, a lateral hole every 5 meters, every 10 meters, every 20 meters, or more. In formations having large numbers of natural fractures, wider spacing may be selected, while in formations having few natural fractures, narrower spacing may be desirable. The diameter of the lateral holes can be about 5 cm, 2 cm, 1 cm, or even less. The lateral holes can extend from the primary wellbore 10 m, 50 m, 100 m, or even farther.

The techniques may be used with any type of hydrocarbon bearing subterranean formation, such as a shale gas formation, a tight oil formation, a coalbed, or any number of other types of formations. Any types of hydrocarbons may be harvested using the techniques described, including oil, gas, or mixed hydrocarbons. Further, the techniques may be used to penetrate other types of formations, such as formations used for the production of geothermal energy. In one embodiment, the techniques can be used to enhance production of natural gas from unconventional reservoirs (e.g., low permeability gas reservoirs, such as shale or coal). In another embodiment, the techniques can be used to enhance oil production from tight carbonate reservoirs. The techniques are not limited to these examples, as they may be used to create small lateral holes in any number of other formations.

Generally, the small lateral holes are drilled from the central wellbore by a hydraulically powered, self propelled drilling assembly. A kicker is placed at the drilling location and is locked in place. The drill bit, attached to a flexible hose, is lowered to the kicker from the surface. The kicker turns the drill bit to face the wall of the well casing. Fluid pumped from the surface, through the flexible hose, powers the drill bit, which penetrates the wall of the casing and into the formation. The flexible hose is pulled into the formation behind the drill bit. Once the small lateral hole is complete, the flexible hose and drill bit can be retracted from the kicker. The kicker is unlocked, and can be repositioned to a new location for further drilling. In one embodiment the kicker may be lowered into position by the flexible hose and locked into place hydraulically by pressurizing the flexible hose to a set pressure. Once the small lateral hole is complete, the flexible hose and drill bit can be retracted, releasing the locking mechanism on the kicker and allowing the kicker to be repositioned to a new location for further drilling.

Further, the well may vertical or horizontal and may be placed at the top of the formation. This utilizes gravity to cause the small lateral holes to bend downward as they penetrate the formation. This can allow for wider access of a formation from a single well.

FIG. 1 is a diagram of a drilling process 100 for forming multiple lateral holes into a formation from a central wellbore. The traditional method of fracture stimulation utilizes "hydraulic" pressure pumping and is a proven technology that has been used since the 1940s in more than 1 million wells in the United States to help produce oil and natural gas. In typical oilfield operations, the technology involves pumping a water-sand mixture into subterranean layers where the oil or gas is trapped. The pressure of the water creates tiny fissures or fractures in the rock. After pumping is finished the sand props open the fractures, allowing the oil or gas to escape from the hydrocarbon bearing formation and flow to a wellbore.

In contrast, the techniques disclosed herein form a series of small lateral holes outward from a central wellbore. For example, a well 102 may be drilled through an overburden 104 to a hydrocarbon bearing subterranean formation 106. Although the well 102 may penetrate through the hydrocarbon bearing subterranean formation 106 and into the underburden 108, small lateral wellbores 110 can be drilled from the well 102 into hydrocarbon bearing subterranean formation 106 to increase the production of hydrocarbons. The small lateral wellbores 110 may be drilled in place of, or in addition to, a fracturing process in the well 102. The small lateral wellbores 110 may turn downward into the hydrocarbon bearing subterranean formation 106 under the force of gravity, crossing numerous bedding planes 112, and potentially intersecting natural fractures.

As described in more detail with respect to the following figures, each of the small lateral wellbores 110 can be drilled by a drilling apparatus, such as a hydraulically powered drill bit, coupled to the end of a flexible hose. A kicker 114 can be used to direct the hydraulically powered drilling assembly towards a wall of the well casing, allowing the hydraulically powered drilling assembly to penetrate the casing and into the formation in a single step. As the hydraulically powered drilling assembly penetrates the formation, the flexible hose is pulled along behind it. Once drilling is completed, a surface apparatus 116 can be used to withdraw the flexible hose from the kicker, allowing the kicker to be repositioned for the drilling of additional small lateral wellbores 110.

Similar to a hydraulic fracturing process, the drilling of the small lateral wells 110 may utilize an extensive amount of equipment at the well site. This equipment may include fluid storage tanks 118 to hold the hydraulic fluid, and blenders 120 to blend the hydraulic fluid with other materials, such as drilling particles 122, acid, and other chemical additives, forming the final hydraulic fluid mixture. The hydraulic fluid may be pressurized and may be at a pressure above the pressure in at least some point in the reservoir pressure. The hydraulic fluid can include water, $CO_2$, $N_2$, hydrocarbons, inert or semi-inert fluids, or any combinations thereof. The fluid may also comprise fine solids with a median effective diameter of the solids of less than 1 mm, less than 50 μm, or less where the effective diameter of the solids may be determined by taking the square root of the quantity of the largest cross-sectional area of a solid multiplied by four and divided by pi.

The low pressure slurry 124 may be run through a treater manifold 126, which may use pumps 128 to adjust flow rates, pressures, and the like, creating a high pressure fluid 130, which can be pumped down the well 102 through the flexible hose to power the hydraulically powered drilling assembly that penetrates the hydrocarbon bearing subterranean formation 106. A mobile command center 132 may be used to control the drilling process.

In one embodiment, the goal of the multi-lateral stimulation is to create a highly-conductive flow zone 134 by intersecting the small lateral wells 110 with natural fractures and hydrocarbon containing pockets in the hydrocarbon bearing subterranean formation 106. In another embodiment the goal of the multi-lateral stimulation is to create a highly-conductive flow zone 134 by increasing the effective contact area of the well 102 and small lateral wells 110 with the subterranean formation 106. Analogous to a fracture zone or cloud in hydraulic fracturing, the highly-conductive flow zone 134 may be considered a network of flow channels generally radiating out from the well 102.

After the drilling process 100 is completed, the hydraulic fluids are flowed back to minimize formation damage. For example, contact with the hydraulic fluids may result in imbibement of the fluids by pores in the hydrocarbon bearing subterranean formation 106, which can lower the productivity of the reservoir. The fluids may also be flushed to remove the materials, for example, with a solvent, acid, or other material that can dissolve or break down residual traces of the hydraulic fluids.

The well 102 is not limited to a vertical orientation. In various embodiments, the orientation may be vertical, horizontal, or at any other appropriate angle, for example, to follow the reservoir interval.

Figure 2:
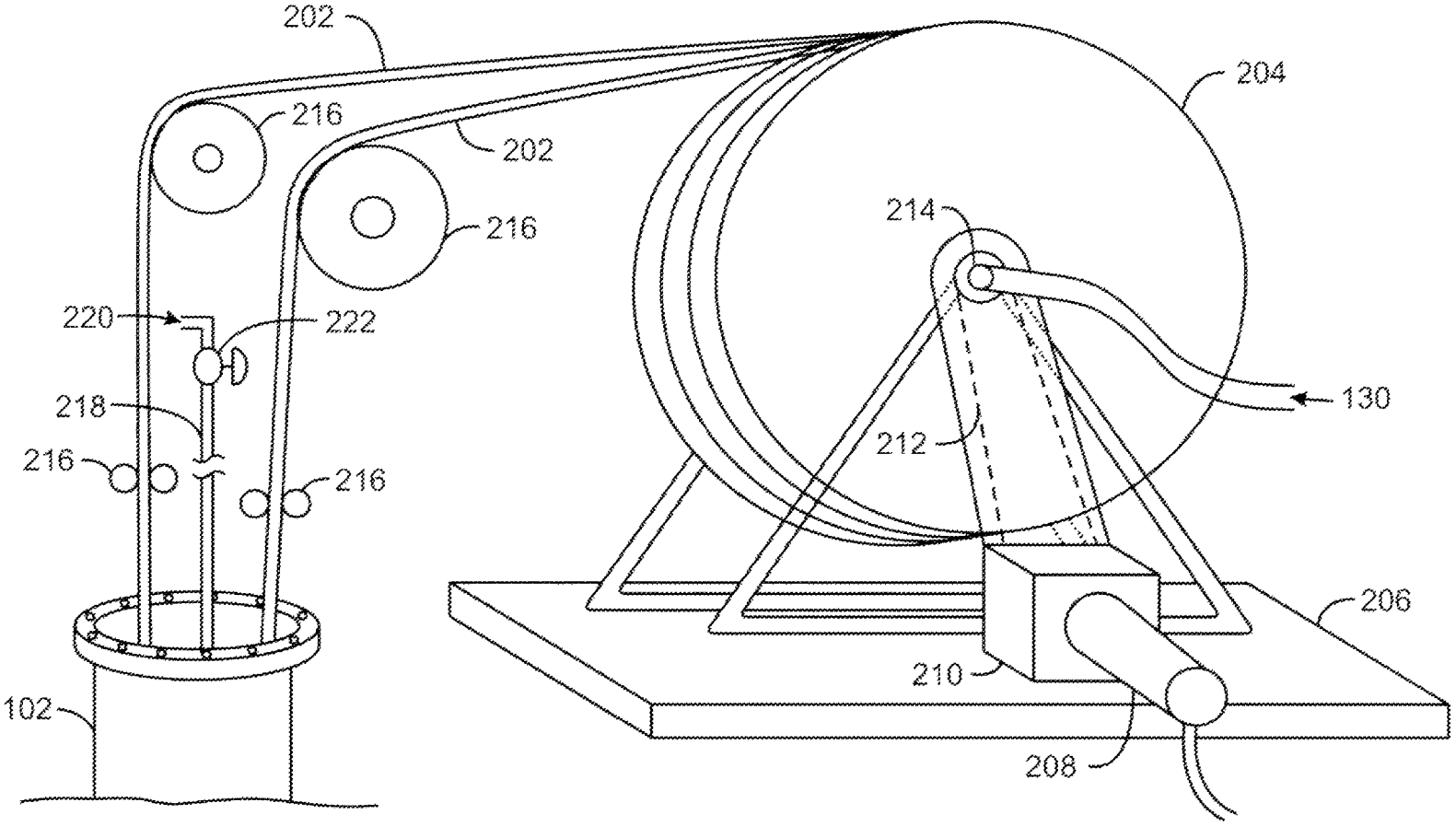
FIG. 2 is a diagram of a surface apparatus used to provide a flexible hose for drilling small lateral wells into a hydrocarbon bearing subterranean formation from a well.

FIG. 2 is a diagram of a surface apparatus 116 used to provide a flexible hose 202 for drilling small lateral wells into a hydrocarbon bearing subterranean formation 106 from a well 102. Like numbered items are as described with respect to FIG. 1. As shown in FIG. 2, the surface apparatus 116 may be used to provide multiple flexible hoses 202 to the well for substantially simultaneously drilling more than one small lateral well at a time. The flexible hose 202 can be provided on a reel 204, for example, mounted on a skid 206. The movement of the reel 204, and, thus, the speed of insertion or retraction of the flexible hose 202 can be controlled by a motor 208 coupled to gearbox 210 that drives a belt or chain 212. The high pressure hydraulic fluid 130 can be provided to a central coupling 214, from which it can be fed to the flexible hose 202. The flexible hose 202 can be directed into the well by rollers 216, which may include drive motor and active braking for further control.

In an embodiment, a flexible control hose 218 may be attached to the kicker to allow it to be locked into place. A hydraulic fluid 220 is used to provide power to lock the kicker, and may also be used to increment the kicker to a new location. Control valves 222 may be used to control the actions of the kicker, such as by setting the hydraulic pressure to different control points at which the different actions occur. For example, a first pressure may lock the kicker into place, while a higher pressure may be used to increment the kicker to point at a different area of the casing wall. In this embodiment, the flexible control hose 218 may also be used to move the kicker.

Figure 3:
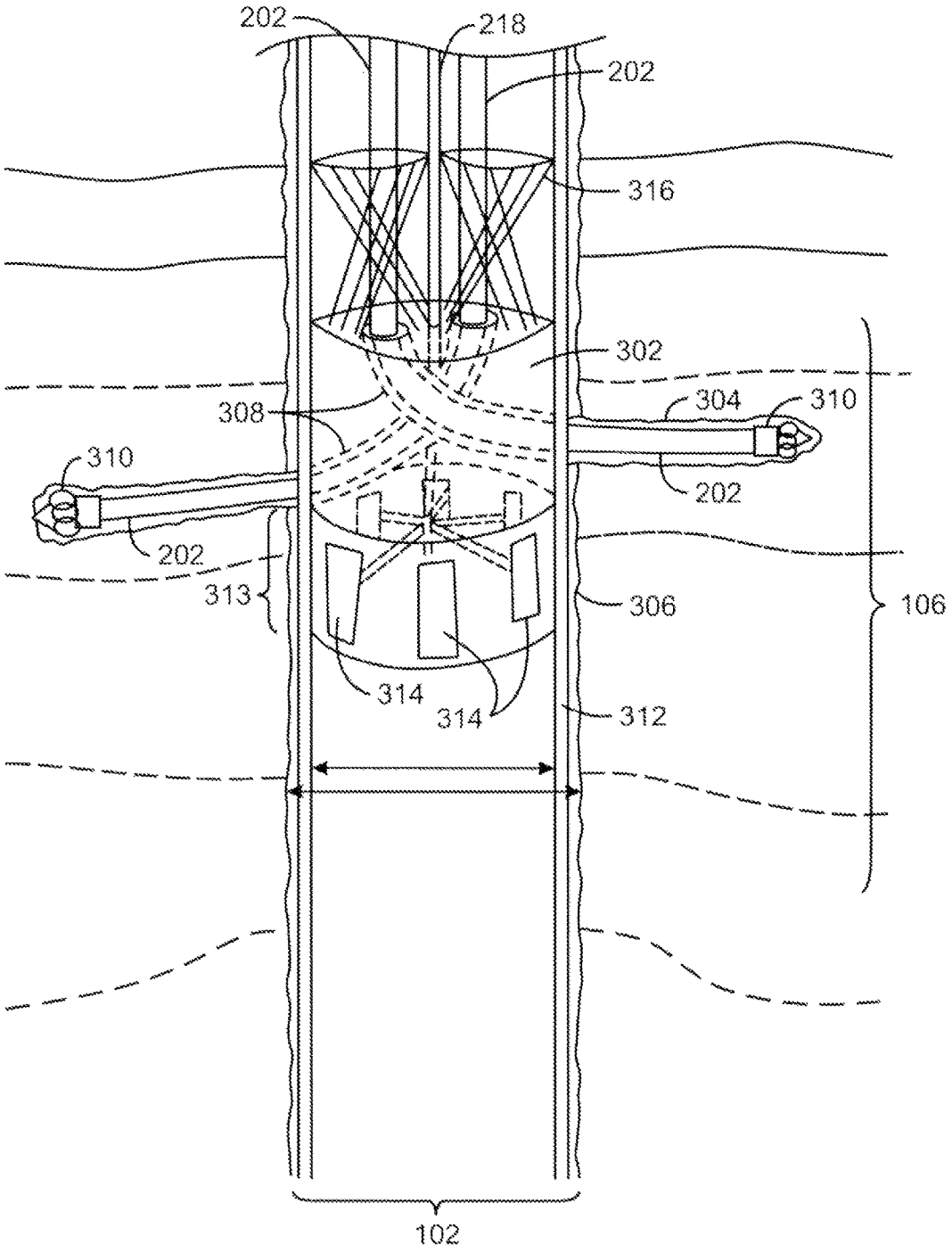
FIG. 3 is a schematic of a kicker that is directing the drilling of two lateral wells from a central well.

FIG. 3 is a schematic of a kicker 302 that is directing the drilling of two lateral wells 304 from a central well 102. Like numbered items are as discussed with respect to FIGS. 1 and 2. The kicker 302 includes at least one path 308 configured to direct a hydraulically powered drilling assembly 310 towards a well casing 312.

The kicker 302 can also include a number of associated systems to make placement and use more efficient. The kicker 302 includes a system 313 for locking it into position in the well 102. For example, a locking system 313 can include a number of hydraulically inflated pads 314 that are coupled to the flexible control hose 218. When a hydraulic fluid is forced into the flexible control hose 218, the pads expand to prevent the kicker 302 from moving. Once the kicker 302 is locked in place, the hydraulically powered drill bits 310 and flexible hoses 202 may be lowered from the surface, and used to drill through the well casing 312 and into the formation 106.

The kicker 302 can include a framework 316 designed to direct each of the hydraulically powered drill bits 310 into a different hole on the kicker 302. The framework 316 may also function to reversibly trap the hydraulically powered drilling assembly 310, allowing the flexible hose 202 to be utilized for moving the kicker 302. In other embodiments, a gyroscopic steering device can be included behind each hydraulically powered drilling assembly 310 to steer the bit into the kicker.

The kicker 302 is not limited to two paths 308, but may include only one path 308, or any number of paths 308, for example, up to four. If the kicker 302 has only one path 308, an indexing system may be used to rotate the kicker 302, so that additional lateral wells 304 can be drilled without moving the kicker 302. For example, the indexing system could be controlled by the hydraulic fluid from the flexible control hose 218, wherein a first pressure locks the kicker 302 into place, and a higher pressure causes the kicker to release and index to a new angular position. In some embodiments, the kicker 302 may index by 60°, 90°, or 180°, depending on the number of lateral wells 304 desired at each location, and the diameter of the central well 102. The indexing would be performed after the hydraulically powered drilling assembly 310 is retracted from a lateral well 304.

Once all desired lateral wells 304 are drilled at the location, the kicker 302 is unlocked and can then be placed in a new location and locked for further drilling.

If drilling activities are complete, the kicker 302 may be brought to the surface to allow the well 102 to be placed into service.

Figure 4:
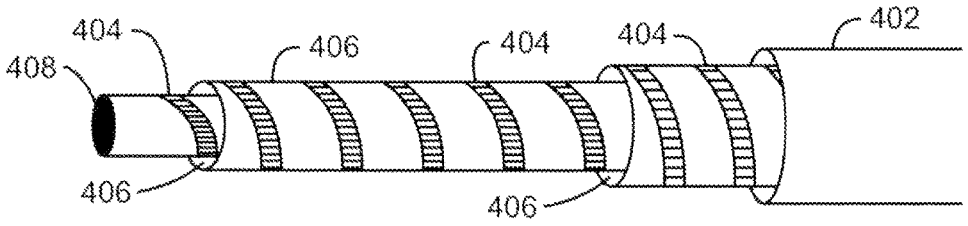
FIG. 4 is a schematic of a flexible hose that can be used to carry fluid to a hydraulically powered drilling assembly.

FIG. 4 is a schematic of a flexible hose 202 that can be used to carry fluid to a hydraulically powered drilling assembly 302. Like numbered items are as discussed with respect to FIG. 2. The flexible hose 202 is configured to convey a high pressure fluid. The flexible hose 202 can be selected to withstand differential pressures in excess of 500 psi, 5000 psi, 10,000 psi or more. Further, the flexible hose 202 may be abrasion resistant to withstand forces in the lateral well. The flexible hose 202 may be made from composite materials that include polyamides, polyimides, corrugated steel, PTFE, carbon fiber, or any combinations thereof, as well as any other suitable high-strength material. As used herein, a flexible hose 202 is capable of bending with a radius of less than about one meter, less than about 10 cm, less than about 2 cm, without plastic deformation or other permanent resulting in a decreased diameter section, e.g., kinking.

The flexible hose may be multilayer structure including, for example, an outer layer 402 may be made from a cross linked elastomer, such as rubber. Numerous inner structures may be used to provide the necessary strength and pressure resistance. Such structures may include multiple layers of a reinforcing material 404, for example, a polyamide, alternating with layers of other materials 406, such as cross linked elastomer. An inner layer 408 may be made from some of the same materials, such as the cross linked elastomer, or may be made from a chemically resistant material, such as Teflon.

The flexible hose 202 is not limited to the materials or structure shown. In other cases, a collapsible hose made from thinner layers of high strength materials, such as carbon fibers or ultrahigh molecular weight polyethylene fibers, could be used.

During drilling, the flexible hose 202 carries a high-pressure fluid to the flexible hose 408, which conveys the high-pressure fluid to the hydraulically-powered drill bit 412. For long horizontal wells a high flow rate may be required, for example, in excess of 10 bbl/day (70.3 l/hour) per hole, in excess of 100 bbl/day (700 l/hour) per hole, or in excess of 1,000 bbl/day (7000 l/hour) per hole. As previously discussed, the injected fluid may include water, for example, at about 80%, wherein the balance of the fluid such as other additives used in a drilling mud. The injected fluid may include primarily $CO_2$ which has a low viscosity, yet relatively high density at the high pressure and temperatures needed for this process. The low viscosity will reduce frictional wellbore losses and enable higher injection rates, while the high density will ensure the fluid can readily achieve high pressures downhole. In these embodiments, the drilling apparatus may use a hammer drill, or other drilling system, capable of penetrating the outer casing. Once the outer casing is penetrated, the drilling apparatus can continue into the formation, as described herein.

Figure 5:
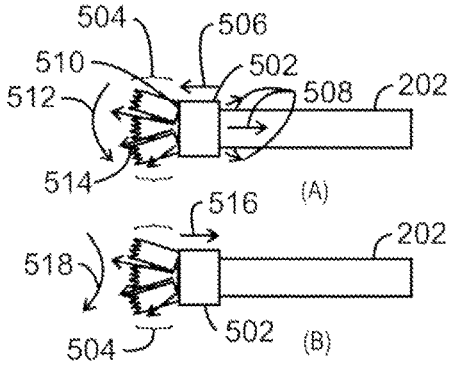
FIG. 5 is a drawing of a hydraulically powered drilling assembly that may be used to penetrate a well casing and a subterranean formation and pull a flexible hose.

FIG. 5 is a drawing of a hydraulically powered drilling assembly 500 that may be used to penetrate a well casing and a subterranean formation and pull a flexible hose 202. Like numbered items are as described with respect to FIG. 2. In this embodiment, during a first cycle, shown in (A), a motor 502 pushes the drill bit 504 forward, as indicated by an arrow 506, by releasing propulsion jets 508 of fluid at the rear of the motor 502. The propulsive force is provided by the pressure differential between the inside of the flexible hose 202 and the pressure in the formation. The jets 508 may also be used to remove formation cuttings and provide lubrication between the formation and the flexible hose 202.

The drill bit 504 may use cylinders 510 with diamond impregnated tips as the abrasive devices. The propulsion jets 508 may also rotate the drill bit 504, as indicated by an arrow 512, for example, by releasing jets of fluid in different direction, further increasing the aggressiveness of the drilling action. A small portion of the fluid, for example, less than about 5%, less than about 2%, or less than about 1%, may be released from the front of the bit as cleaning jets 514. The cleaning jets 514 can help to keep the bit clear of material when drilling in clay or shale based materials.

During a second cycle, shown in (B), the propulsion jets 508 are interrupted, allowing the drill bit 504 to pull back from the formation, as shown by an arrow 516. During this cycle, the drill bit 504 may rotate in the opposite direction, or return to an initial rotary position, as shown by an arrow 518. Alternatively the drill bit may rotate in the same direction or not rotate at all during this cycle. In one embodiment, the drill bit 504 has no motor 506 or other internal drive mechanism to power rotation, but merely moves back and forth as the jets 508 are pulsed.

Figure 6:
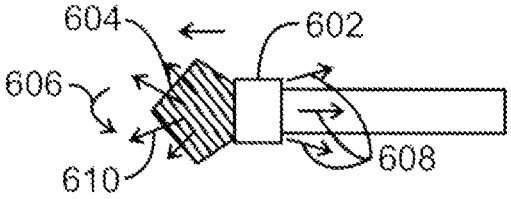
FIG. 6 is drawing of another drilling apparatus that may be used to penetrate a formation and pull a flexible hose through the formation.

FIG. 6 is drawing of another drilling apparatus 600 that may be used to penetrate a formation and pull a flexible hose through the formation. In this configuration, the motor 602 may impart a direct rotary movement to the drill bit 604, as indicated by an arrow 606. The rotary movement may be provided, for example, by a turbine, or other system, in the motor 602. Propulsion jets 608 may be intermittently or continuously released, pushing the drill bit 604 against the casing wall and formation rock. The drilling apparatus 600 may use a different type of drill bit 604 than shown in FIG. 5. For example, the drill bit 604 may be a rotary type bit configured to mechanically abrade materials it contacts as it rotates. As for the drill bit 504 discussed with respect to FIG. 5, the rotary drill bit 604 may release a small amount of the fluid as cleaning jets 610.

The drilling apparatuses that can be used in embodiments are not limited to the configurations shown in FIGS. 5 and 6. Any number of other configurations and motions can be used to effective abrade and penetrate the casing wall and formation.

Figure 7:
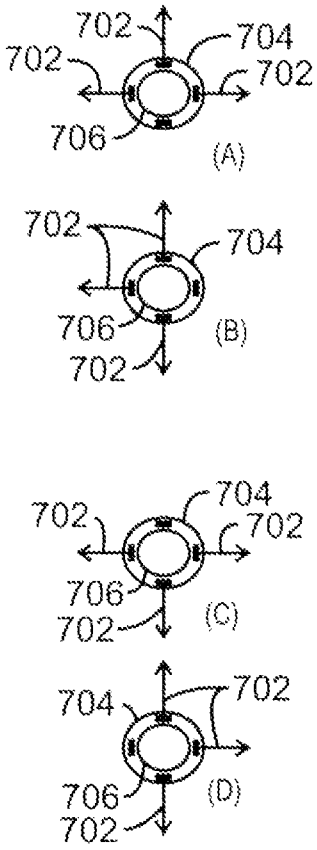
FIG. 7 is a rear view of a drilling apparatus showing propulsion jets that can be used to propel the drilling apparatus through a casing wall and into a formation.

FIG. 7 is a rear view of a drilling apparatus 700 showing propulsion jets 702 that can be used to propel the drilling apparatus 700 through a casing wall and into a formation. In this embodiment, the propulsion jets 702 are shown as intermittently pulsing from the drilling motor 704. The fluid for the jets is provided by the flexible hose 706, shown as a cross section in the center. The pattern may be asymmetrical, for example, pulsing out of three openings, while leaving a fourth opening inactive. As the pattern cycles from (A) through (D), this imparts a horizontal vector on the drill bit, as well as a forward propulsive vector. Thus, an axial motion may be created by a configuration in the bit that allows fluid to exit different channels as the bit rotates. As the channels may be oriented to direct the fluid in different directions, this changes the net effective force axially applied on the drill bit by the fluid momentum.

The propulsion jets 702 are not limited to an asymmetrical configuration, but may be intermittently symmetrically pulsated, for example, at high frequency and at varying rates, causing the net effective force axially applied to the drill bit 506 to change. In addition to the propulsion resulting from directional fluid leak-off, gravity can be used to assist in driving the apparatus and hose into the formation.

Figure 8:
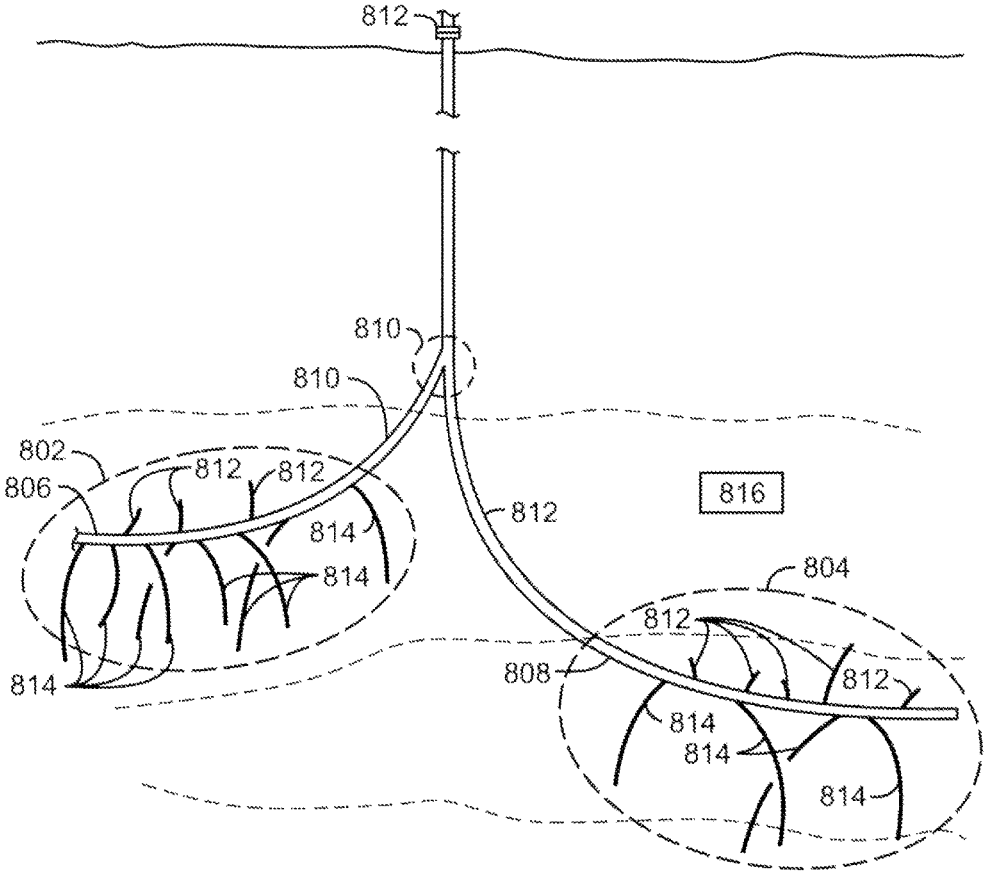
FIG. 8 is a drawing of two reservoir intervals, each having a horizontal well segment.

FIG. 8 is a drawing 800 of two reservoir intervals 802 and 804, each having a horizontal well segment 806 and 808. In this example, each horizontal well segment 806 and 808 is about 100 m, although the horizontal segments may be of any suitable length, for example, 1000 m, 2000 m, or longer. A branch point 810 in the main well 812 may be drilled by any suitable tool, as described herein.

From each horizontal well segment 806 and 808, two lengths of lateral wells 812 and 814 may be drilled outwards. A shorter length of lateral well 812 may be used to access resources towards the top of each reservoir interval 802 and 804, while a longer length of lateral well 814 may be used to access resources towards the bottom of each interval. The spacing of the lateral wells 812 and 814 may be determined by the productivity gains desired, as discussed with respect to FIG. 9, below. As shown, the shorter lateral wells 812 may not curve downwards, but be pulled substantially straight out from the well 810. This may be controlled by the angle of drilling, the length of the lateral wells 812, the rate of penetration, the difference between the hydraulic pressure in the lateral wells and that in the formation, and the characteristics of the rock making up the formation 816. In one example, a softer rock that allows for high penetration rates may minimize the effects of slow drilling and gravity. In another example, drilling through a carbonate rock with an acidic fluid as the propulsion, and at a substantially slow rate, may allow gravitational effects to dominate the direction of penetration of the lateral wells. In another example, the rate of flow of hydraulic fluid in the lateral wells may be sufficiently high enough to result in a relatively high fluid pressure inside the lateral wells, causing them to maintain a substantially rigid form and follow a substantially straight path. The longer lateral wells 814 may slowly curve downwards under the force of gravity, allowing longer paths, as discussed further with respect to FIG. 9.

Figure 9:
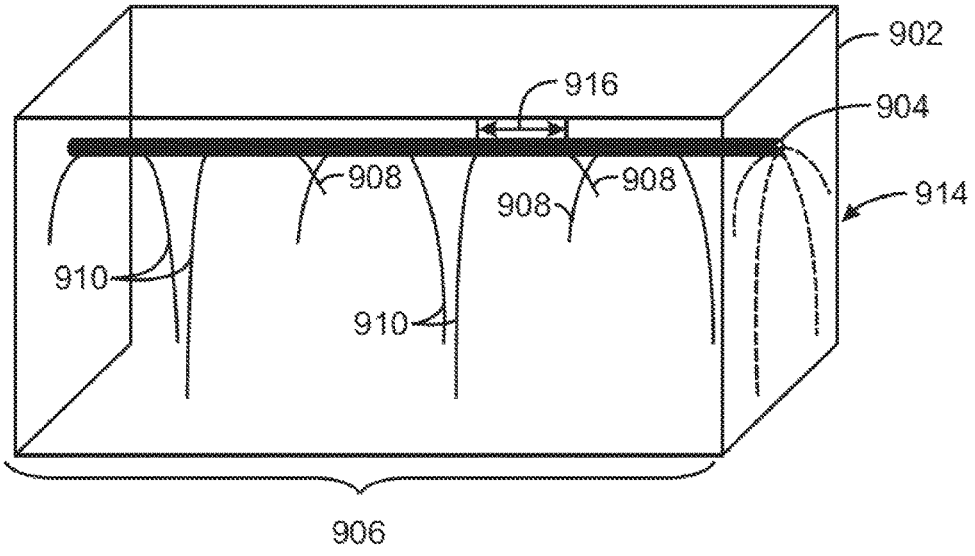
FIG. 9 is another drawing of a reservoir interval that has a horizontal well.

FIG. 9 is another drawing 900 of a reservoir interval 902 that has a horizontal well 904. In this example, the horizontal well 904 is also drilled towards the top of the reservoir interval 902. As in FIG. 8, the length 906 of the reservoir interval 902 is around 100 m. However, in this example, both short lateral wells 908 and longer lateral wells 910 are allowed to curve downward into the reservoir interval 902, for example, assisted by the force of gravity, giving the cross-sectional profile indicated as reference number 914. The separation 916 between the lateral wells 908 and 910 along the horizontal well 904 may be about 5 m, about 20 m, or longer.

Modeled Example

A simulation model was built to compare gas production from a typical fracture network generated in a shale formation by hydraulic fracturing vs. that generated by the method described herein to determine if similar improvements in flow could be achieved. The models indicated that similar improvements in flow were possible, and provided guidance on the number of lateral wells needed to achieve these results, described in this invention which creates highly-connected, high-flow networks.

Figure 10:
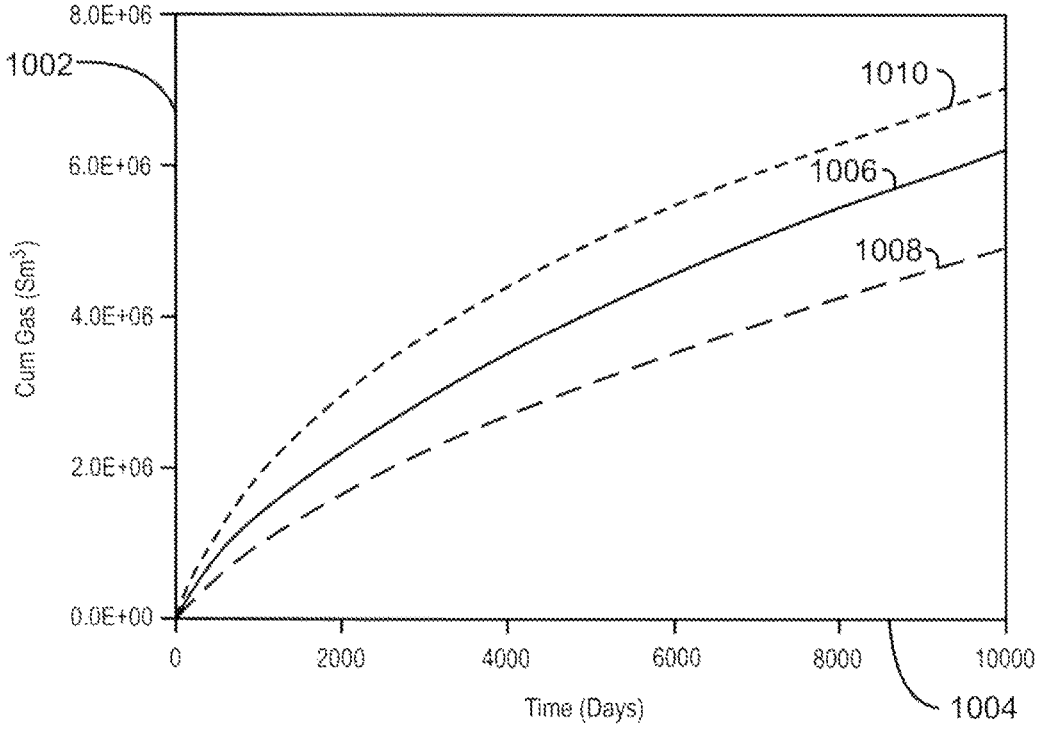
FIG. 10 is a plot showing the efficacy of drilling small lateral wells from a wellbore in comparison to hydraulic fracturing.

FIG. 10 is a plot showing the efficacy of drilling small lateral wells from a wellbore in comparison to hydraulic fracturing. In the plot, the y-axis 1002 represents cumulative gas production from a model of a shale formation and the x-axis 1004 represents the time in days. Gas production rates 1006 for a typical bi-wing fracture are compared to results for two different densities of high-flow networks created using the techniques described herein. Gas production rates 1008 at 1 hole every 10 meters was slightly less than the gas production rates 1006 for hydraulic fracturing. However, the gas production rates 1010 at a density of 1 hole every 5 meters increased by 25-35% over the gas production rates 1006 of hydraulic fracturing. Further, cumulative production after one decade for the technique discussed herein also demonstrates potential to outperform traditional hydraulic fracturing techniques, with uplifts in cumulative gas produced in excess of 30%. Even over a 30 year life of the well the uplift may still exceed traditional hydraulic fracturing by 10%. Thus, simulation models demonstrate the method discussed herein has potential to be competitive from a production stand-point with existing hydraulic fracturing methods.

A Method for Penetrating a Subsurface Formation

Figure 11:
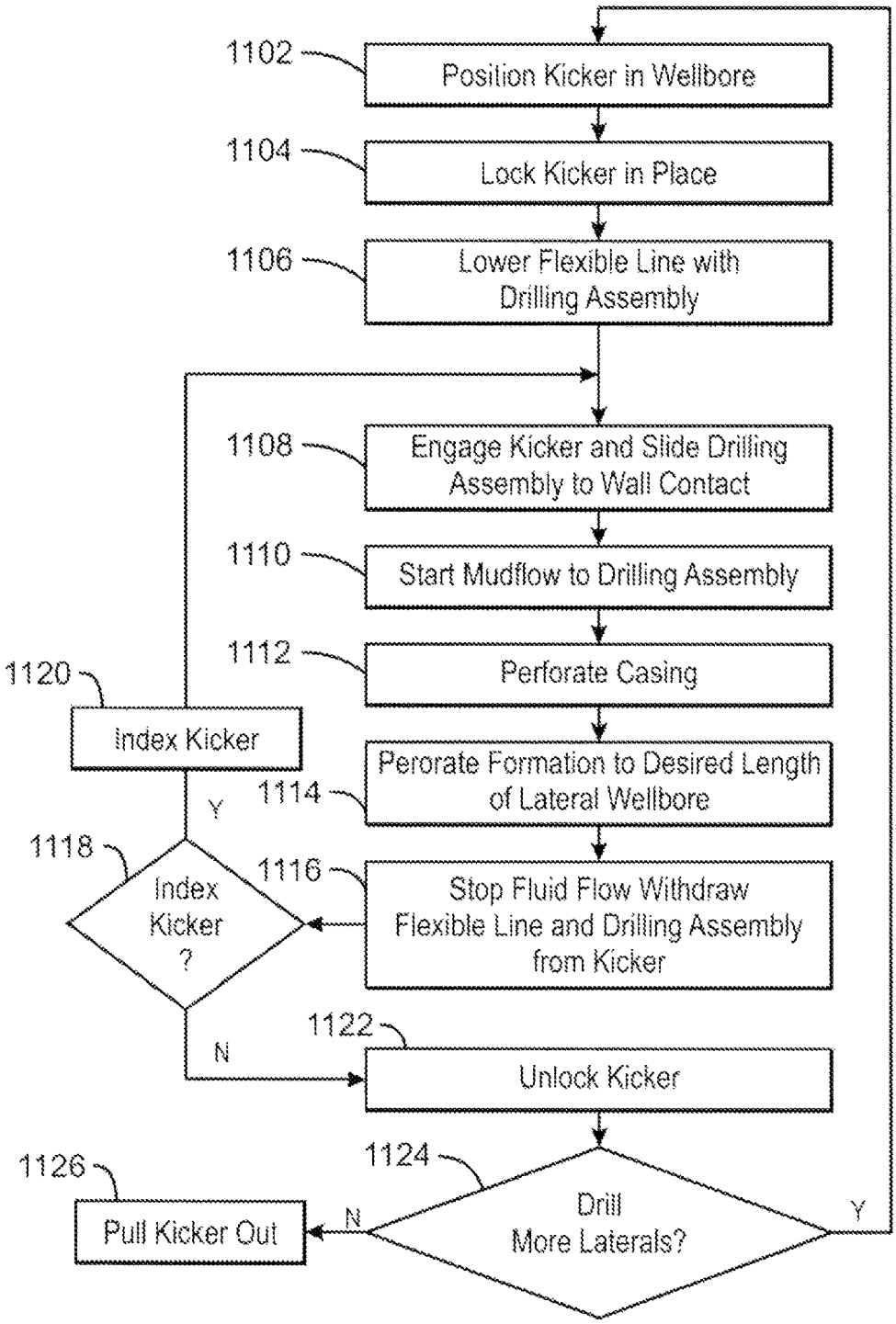
FIG. 11 is a process flow diagram of a method for creating a number of small lateral wells from a main well in a formation.

FIG. 11 is a process flow diagram of a method 1100 for creating a number of small lateral wells from a main well in a formation. The small lateral wells generate a high-flow network in fluid communication with a primary wellbore. The method 1100 begins at block 1102 with the positioning of the kicker in the wellbore. As described with respect to the preceding figures, the kicker can be move by a flexible control hose, or by flexible hoses used to power a hydraulic drill for forming the small lateral wells.

At block 1104, the kicker is locked in position. For example, a hydraulic fluid may be pumped down a flexible control line to pressurize pads that hold the kicker in place. At block 1106 the drilling assembly is lowered by the attached flexible line to the kicker. At block 1108, the drilling assembly engages the kicker, and is slid into place at the wall of a casing. In various embodiments, fluid may be flowed through the flexible line to set the kicker or drive the hose into the kicker.

At block 1110, the fluid flow to the drilling assembly begins the drilling process. As described herein, the drilling assembly uses a hydraulically-powered drill bit to perforate the casing (block 1112) and drill the small lateral well into the formation (block 1114) using a rotary motion, an axial motion, or a combination thereof. Two or more drilling assemblies may be used to concurrently penetrate the formation. The high pressure hose is pulled into the formation by both gravitational force and the force issuing from the fluid leak-off exiting small perforations at the rear of the drill bit at high-velocity. The direction of penetration of the hoses and apparatuses in the formation may be governed by both gravity and the direction of the hydraulic fluid leaving the small perforations near the drill bits. The injection of the hydraulic fluid into a flexible hose and its associated drilling apparatus may be at a rate greater than 500 barrels of fluid per day (about 3000 liters per day) per hose. The hydraulic fluid may include more than 80% water by volume, although highly compressed gasses may be used.

At block 1116, the fluid flow is stopped, and the flexible hose and drilling assembly are withdrawn from the kicker. If a determination is made at block 1118 that the kicker is to be indexed for a new set of holes, at block 1120, the indexing takes place, for example, by pulsing the pressure of the hydraulic fluid supplied by the flexible control line. Process flow then proceeds to block 1108 to repeat the drilling process.

If the kicker is not to be indexed, at block 1122, the kicker is unlocked to allow it to be repositioned. If a determination is made at block 1124 that more small lateral wells are to be drilled, process flow restarts at block 1102. If not, at block 1126 the kicker is pulled from the well, for example, to allow production to be started.

Embodiments

It should be understood that the preceding is merely a detailed description of specific embodiments of this invention and the numerous changes, modifications, and alternatives to the disclosed embodiments can be made in accordance with the disclosure here without departing from the scope of the invention. Rather, the scope of the invention is to be determined only by the appended claims and their equivalents.

What is claimed is:

1. An apparatus for penetrating a subsurface formation, comprising:

a kicker configured to direct each of at least two drilling apparatus towards a well casing, the kicker including a framework configured for directing each of the at least two drilling apparatus in a selected angular orientation along a distinct path through the kicker and toward the well casing;

each of the at least two drilling apparatus including a flexible hose configured to convey a fluid from a surface pump to the drilling apparatus, the drilling apparatus including a drill bit that is mechanically and fluidly engaged with an end of the flexible hose, wherein the drill bit is configured to rotationally drill through and penetrate a well casing and into a subsurface formation, and wherein the drill apparatus is configured to pull the flexible hose into the subsurface formation as the drill bit drills into and penetrates the subsurface formation.

2. The apparatus of claim 1, wherein the drilling apparatus comprises a hydraulically-powered drill bit.

3. The apparatus of claim 2, wherein the hydraulically-powered drill bit is propelled into the formation by release of the fluid from jets disposed behind the hydraulically-powered drill bit.

4. The apparatus of claim 1, wherein the drilling apparatus comprises a plurality of nozzles configured to release a portion of the fluid through the drill bit.

5. The apparatus of claim 1, wherein the drilling apparatus comprises a hammer drill.

6. The apparatus of claim 1, wherein the drilling apparatus comprises a rotary drill.

7. The apparatus of claim 1, wherein the kicker is designed to direct each of the flexible hoses in a selected orientation index towards the casing.

8. The apparatus of claim 1, wherein the kicker is configured to be unlocked by changes in the fluid pressure inside the flexible hose.

9. The apparatus of claim 1, wherein the flexible hose has a bending radius of less than one meter without having a decreased diameter.

10. The apparatus of claim 1, wherein the flexible hose comprises a multilayer structure.

11. The apparatus of claim 1, where the flexible hose comprises a metal braid.

12. The apparatus of claim 1, wherein the flexible hose comprises a polyaramid.

13. The apparatus of claim 1, wherein the flexible hose comprises an ultra-high molecular weight polyethylene.

14. The apparatus of claim 1, wherein the fluid comprises at least about 80% by volume water.

15. The apparatus of claim 1, wherein the fluid comprises an acid.

16. The apparatus of claim 1, where the well casing comprises concrete.

17. The apparatus of claim 1, wherein the well casing comprises a metal.

18. The apparatus of claim 17, wherein the metal comprises iron.

19. A method of creating a high flow network in subterranean formation, comprising:

positioning a kicker in a wellbore at a target location, the kicker including a framework for selectively directing each of at least two drilling apparatus in a selected angular orientation, the framework configured to direct each of the at least two drilling apparatus along a distinct path through the kicker and at a casing of the wellbore, each of the at least two drilling apparatus including a drill bit that is mechanically and fluidly engaged with an end of a flexible hose configured to convey a fluid to the drill bit;

directing the framework in the selected angular orientation;

locking the kicker in place at the target location and in the selected angular orientation;

threading each of the at least two drilling apparatus into the kicker; and injecting a fluid into the flexible hose for each of the at least two drilling apparatus, wherein the fluid flow through the flexible hose drives the drilling apparatus to rotationally drill through and penetrate the casing and into the subterranean formation and to pull the associated flexible hose into the formation the drill bit rotationally drills into the subsurface formation.

20. The method of claim 19, comprising propelling each of the at least two drilling apparatus into the subterranean formation, at least in part, by force resulting from a pressure differential between the fluid inside the associated flexible hose and the fluid outside of the associated flexible hose.

21. The method of claim 19, comprising:

retracting each flexible hose and drilling apparatus from the kicker once drilling is finished at the targeted location;

unlocking the kicker;

moving the kicker to a new location;

locking the kicker in place at the new location; and replacing the flexible hose and drilling apparatus in the kicker.

22. The method of claim 19, comprising:

retracting the flexible hose and drilling assembly from the kicker once drilling is finished at the selected angular orientation;

moving the framework to a new angular orientation; and replacing the flexible hose and drilling assembly in the kicker at the new angular orientation; and injecting the fluid into the flexible hose to cause the drill bit to rotationally drill through and penetrate the casing at the new angular orientation and into the subterranean formation and to pull the associated flexible hose into the formation as the drill bit rotationally drills into the subsurface formation.

23. A method of producing hydrocarbons from a subterranean formation, comprising:

creating a high flow network in the subterranean formation by drilling a small lateral well from a main well by:

positioning a kicker in a wellbore at a target location, the kicker including a framework for selectively directing each of at least two drilling apparatus in a selected angular orientation, the framework configured to direct each of the at least two drilling apparatus along a distinct path through the kicker and at a casing of the wellbore, each of the at least two drilling apparatus including a drill bit that is mechanically and fluidly engaged with an end of a flexible hose configured to convey a fluid to the drill bit;

directing the framework in the selected angular orientation;

locking the kicker in place at the target location and in the selected angular orientation;

threading each of the at least two drilling apparatus into the kicker; and injecting a fluid into the flexible hose for each of the at least two drilling apparatus, wherein the fluid flow through the flexible hose drives the drilling apparatus to rotationally drill through and penetrate the casing and into the subterranean formation and to pull the associated flexible hose into the formation the drill bit rotationally drills into the subsurface formation; and producing the hydrocarbons from the subterranean formation.

24. The method of claim 23, comprising:

retracting each flexible hose and drilling apparatus from the kicker once drilling is finished at the targeted location;

unlocking the kicker;

moving the kicker to a new location;

locking the kicker in place at the new location;

replacing the flexible hose and drilling apparatus in the kicker; and drilling through the casing and formation with the drilling apparatus while pulling the flexible hose into the formation with the drilling apparatus as the drill bit penetrates the formation.

25. The method of claim 23, comprising drilling a plurality of small lateral holes from the main well.

26. The method of claim 23, comprising producing natural gas from the formation.

27. The method of claim 23, comprising:

retracting the flexible hose and drilling assembly from the kicker once drilling is finished at the selected angular orientation;

moving the framework to a new angular orientation; and replacing the flexible hose and drilling assembly in the kicker at the new angular orientation; and injecting the fluid into the flexible hose to cause the drill bit to rotationally drill through and penetrate the casing at the new angular orientation and into the subterranean formation and to pull the associated flexible hose into the formation as the drill bit rotationally drills into the subsurface formation.

* * * * *